US006857894B2

(12) United States Patent
Riku

(10) Patent No.: US 6,857,894 B2
(45) Date of Patent: Feb. 22, 2005

(54) ELECTRICAL CONNECTOR HAVING A CONTACT AND SPRING MEMBER

(75) Inventor: Kazuya Riku, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 10/694,384

(22) Filed: Oct. 27, 2003

(65) Prior Publication Data

US 2004/0087203 A1 May 6, 2004

(30) Foreign Application Priority Data

Oct. 31, 2002 (JP) ..... 2002-317977

(51) Int. Cl.[7] ..... H01R 11/20
(52) U.S. Cl. ..... 439/417; 439/412; 439/426
(58) Field of Search ..... 439/417–418, 439/425, 404, 409, 422, 426, 411–412

(56) References Cited

U.S. PATENT DOCUMENTS 5,417,583 A * 5/1995 Ishizaki et al. ..... 439/409
6,416,350 B1 * 7/2002 Harting et al. ..... 439/422

FOREIGN PATENT DOCUMENTS

| | | | |
|---|---|---|---|
| JP | 52-048089 | 4/1977 | ..... H01R/9/08 |
| JP | 56-30955 | 7/1981 | ..... H01R/4/24 |
| JP | 61-133584 | 6/1986 | ..... H01R/4/24 |
| JP | 2002-175845 | 6/2002 | ..... H01R/4/24 |

* cited by examiner

*Primary Examiner*—Truc T. T. Nguyen
(74) *Attorney, Agent, or Firm*—Barley Snyder Senft & Cohen, LLC

(57) ABSTRACT

An electrical connector comprises a terminal block and a housing. The terminal block has an electric wire receiving passageway that communicates with a spring receiving passageway. The terminal block moves between a pre-latched position and a locked position. The housing is provided with a contact having a piercing member for piercing a sheathing member of an electric wire. The piercing member urges the electric wire toward the spring receiving passageway when the terminal block is moved to the locked position. A spring member is arranged in the spring receiving passageway. The spring member has a contact retaining portion for urging the electric wire toward the piercing member as the piercing member urges the electric wire toward the contact retaining portion. A support arm additionally presses the electric wire toward the piercing member.

25 Claims, 9 Drawing Sheets

ELECTRICAL CONNECTOR HAVING A CONTACT AND SPRING MEMBER

FIELD OF THE INVENTION

The invention relates to an electrical connector provided with a contact having a piercing member that pierces a sheathing member of an electric wire for making electrical contact with a core wire therein.

BACKGROUND OF THE INVENTION

Various conventional methods exist for connecting a contact and an electric wire. One such method connects the electric wire and the contact by pressure welding. The pressure welding method is used for connecting an electric wire having a core wire sheathed with a sheathing member to a sharp piercing member of a contact.

For example, Japanese Patent Publication No. 56-30955 teaches a contact that has a piercing member with a sharp end. The piercing member has a pair of press-fitting sections that expand upward and open outward. When an electric wire is connected to the contact, the sharp end of the piercing member pierces a sheathing member of the electric wire such that a core wire of the electric wire and the piercing member are brought into contact with each other. The press-fitting sections maintain the contact of the core wire and the piercing member by bending along an outer periphery of the sheathing member so as to cover the outer periphery of the sheathing member after the piercing member is brought into contact with the core wire. In a case where the core wire is formed by combining a plurality of wires, however, when the piercing member pierces into the electric wire, the external piercing force deforms the electric wire causing the plural wires to spread-out in the sheathing member. Because the press-fitting sections are subject to plastic deformation over a long period of time, the press-fitting sections may not be able to keep all the wires of the core in contact with the piercing member.

In an effort to solve this problem, Japanese Patent Laid-Open No. 61-133584 teaches an electrical connector with a means for preventing an electric wire from being deformed when a piercing member pierces into the electric wire. The electrical connector includes a contact having a sharp piercing member and a cover housing with a holding section that retains a circumferential surface of the electric wire. The holding section is made of a rigid resin material. Since the sheathing member of the electric wire is elastic, the sheathing member allows the electric wire to be firmly held by the holding section when a connection is made, thereby, preventing the deformation of the electric wire. The elasticity of the sheathing member of the electric wire, however, is prone to dissipate by secular changes after the connection is made. Once the elasticity of the sheathing member is dissipated, the electric wire moves relative to the piercing member, reducing the reliability of the electrical connection between the core wire and the piercing member.

In another example, Japanese Patent Laid-Open No. 2002-175845 teaches an electrical connector that has a terminal block including a plurality of electric wires laterally arranged in a line according to contacts laterally arranged in a predetermined pitch. U-shaped elastic members are arranged in the terminal block according to the array pitch of the plural electric wires. Opposing portions of the U-shaped elastic members flank the sides of the electric wires. The opposing portions are urged toward each other, to hold the respective electric wire therebetween. A piercing member of the contact pierces into the electric wire from below to make a connection therewith. The U-shaped elastic members prevent the electric wires from being deformed when the connection is made. The U-shaped elastic members also prevent movement of the electric wire relative to the piercing member, even when a sheathing member of the electric wire loses elasticity due to secular changes. When the electrical connector, however, is used with electric wires having a large-diameter without changing the array pitch of the contacts, the space between adjacent electric wires is reduced, thereby, eliminating the space needed to arrange the U-shaped elastic members in the terminal block. As a result, cracking may occur during formation of the terminal block.

SUMMARY OF THE INVENTION

It is therefore an object of the invention to provide an electrical connector for a large-diameter electric wire whereby the relative movement of the electric wire and a piercing member can be controlled over an extended period of time.

This and other objects are achieved by an electrical connector comprising a terminal block and a housing. The terminal block has an electric wire receiving passageway that communicates with a spring receiving passageway. The housing is provided with a contact having a piercing member that extends into the electric wire receiving passageway. The piercing member pierces a sheathing member of an electric wire received in the electric wire receiving passageway. A spring member is arranged in the spring receiving passageway and has a contact retaining portion that urges the electric wire toward the piercing member.

This and other objects are further achieved by an electrical connector comprising a terminal block and a housing. The terminal block has an electric wire receiving passageway that communicates with a spring receiving passageway. The terminal block moves between a pre-latched position and a locked position. The housing is provided with a contact having a piercing member for piercing a sheathing member of an electric wire. The piercing member urges the electric wire toward the spring receiving passageway when the terminal block is in the locked position. A spring member is arranged in the spring receiving passageway. The spring member has a contact retaining portion for urging the electric wire toward the piercing member as the piercing member urges the electric wire toward the contact retaining portion.

DETAILED DESCRIPTION OF THE INVENTION

Figure 1:
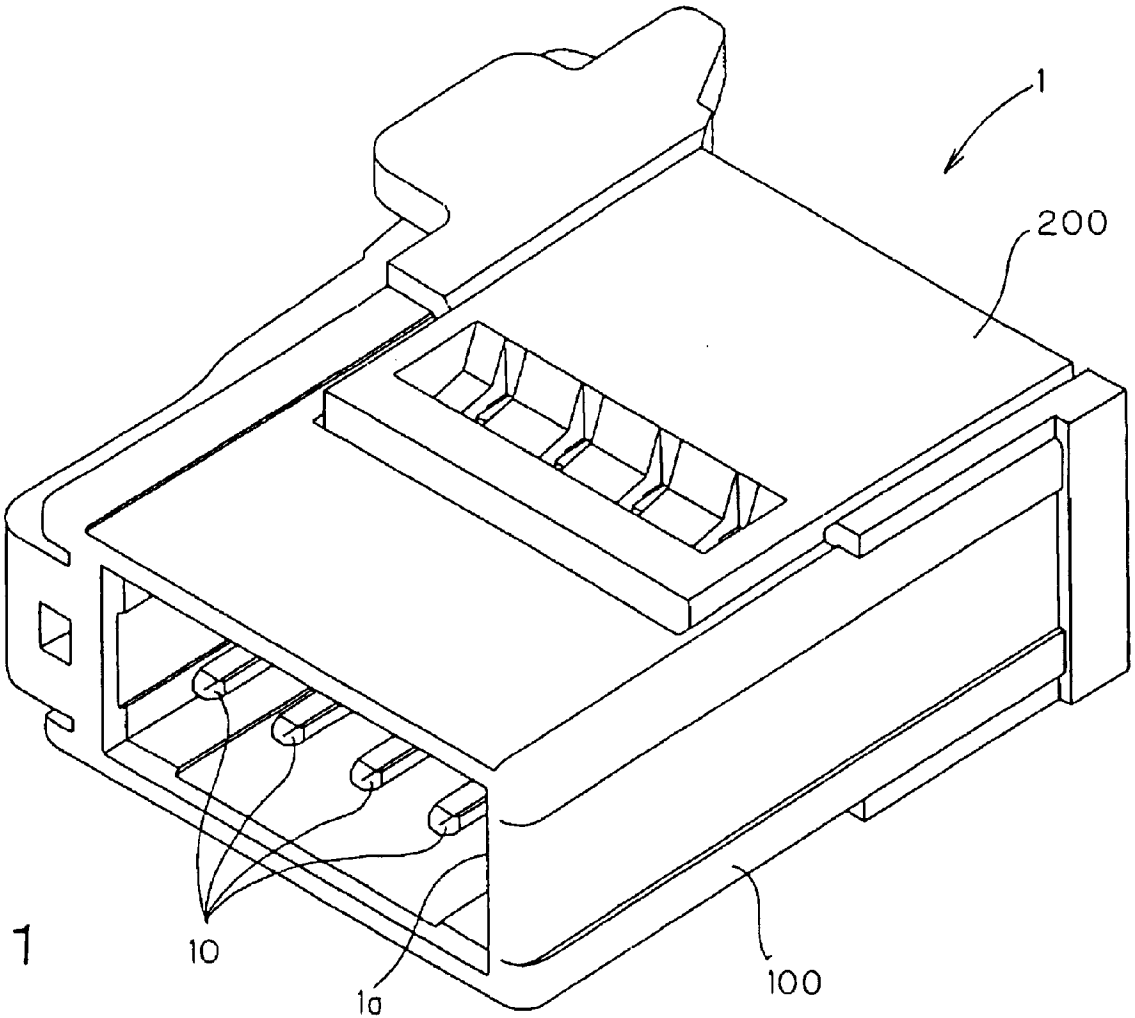
FIG. 1 is a perspective view of an electrical connector of the invention from a front side.
Figure 2:
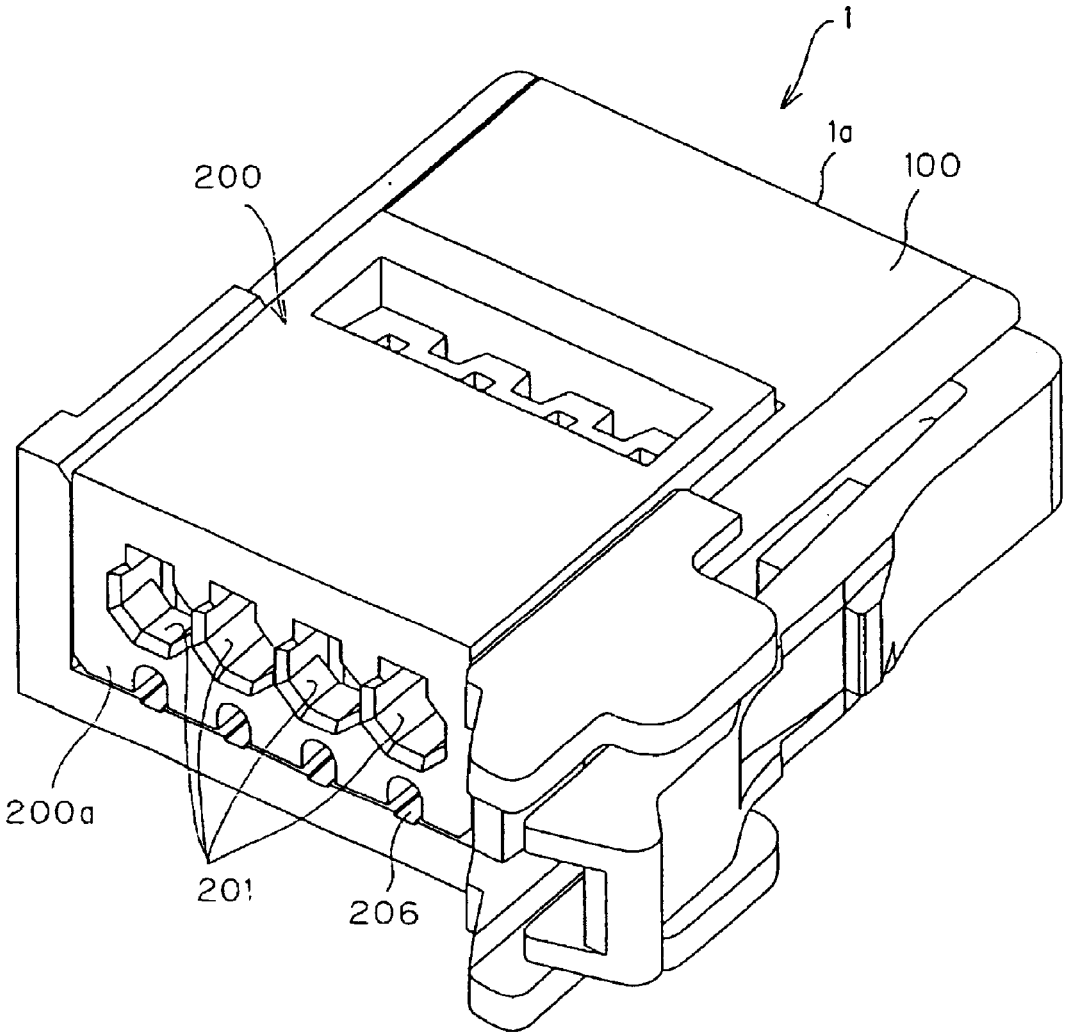
FIG. 2 is a perspective view of the electrical connector of FIG. 1 from a rear side.
Figure 3:
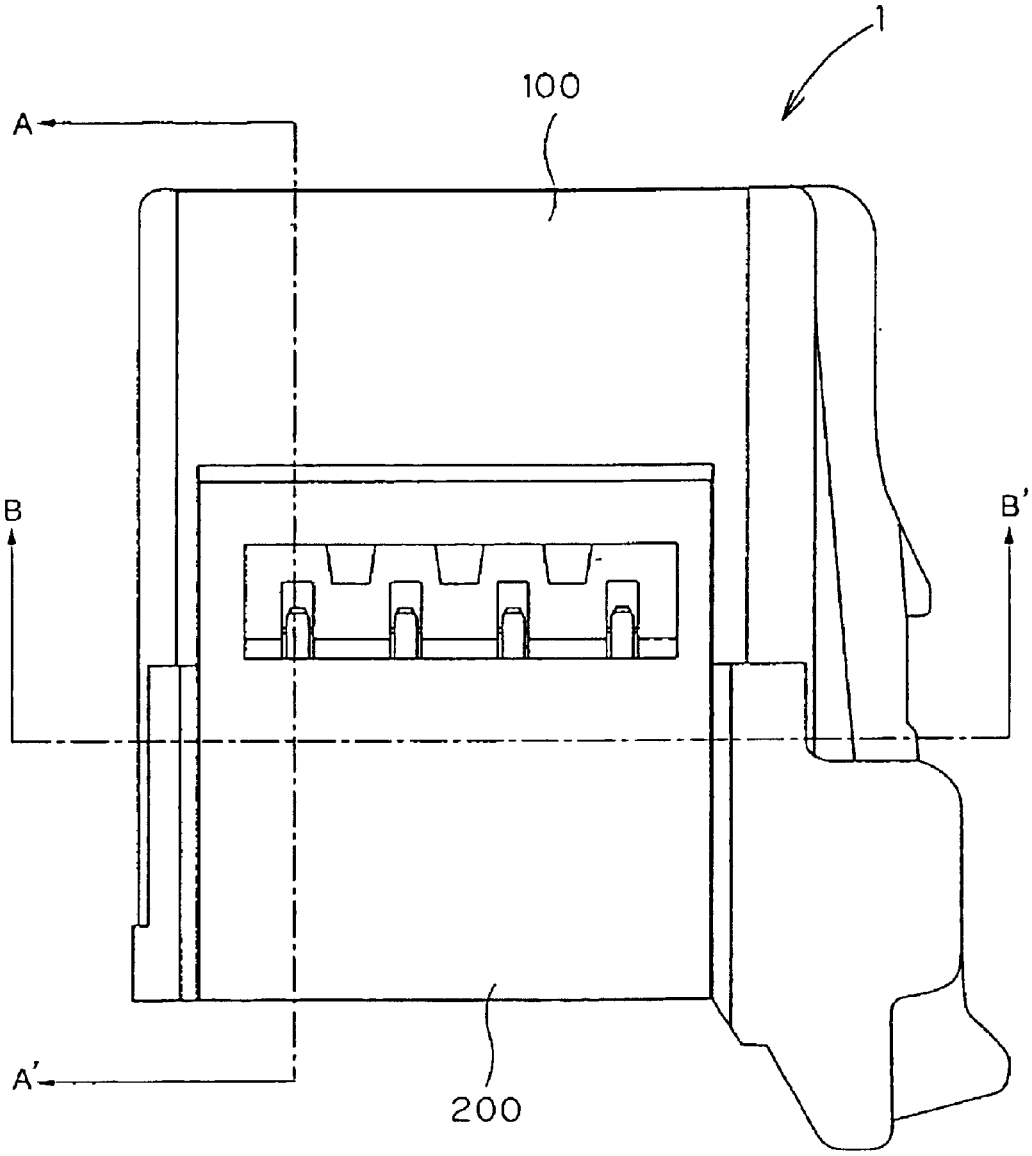
FIG. 3 is a top plan view of the electrical connector of FIG. 1.
Figure 4:
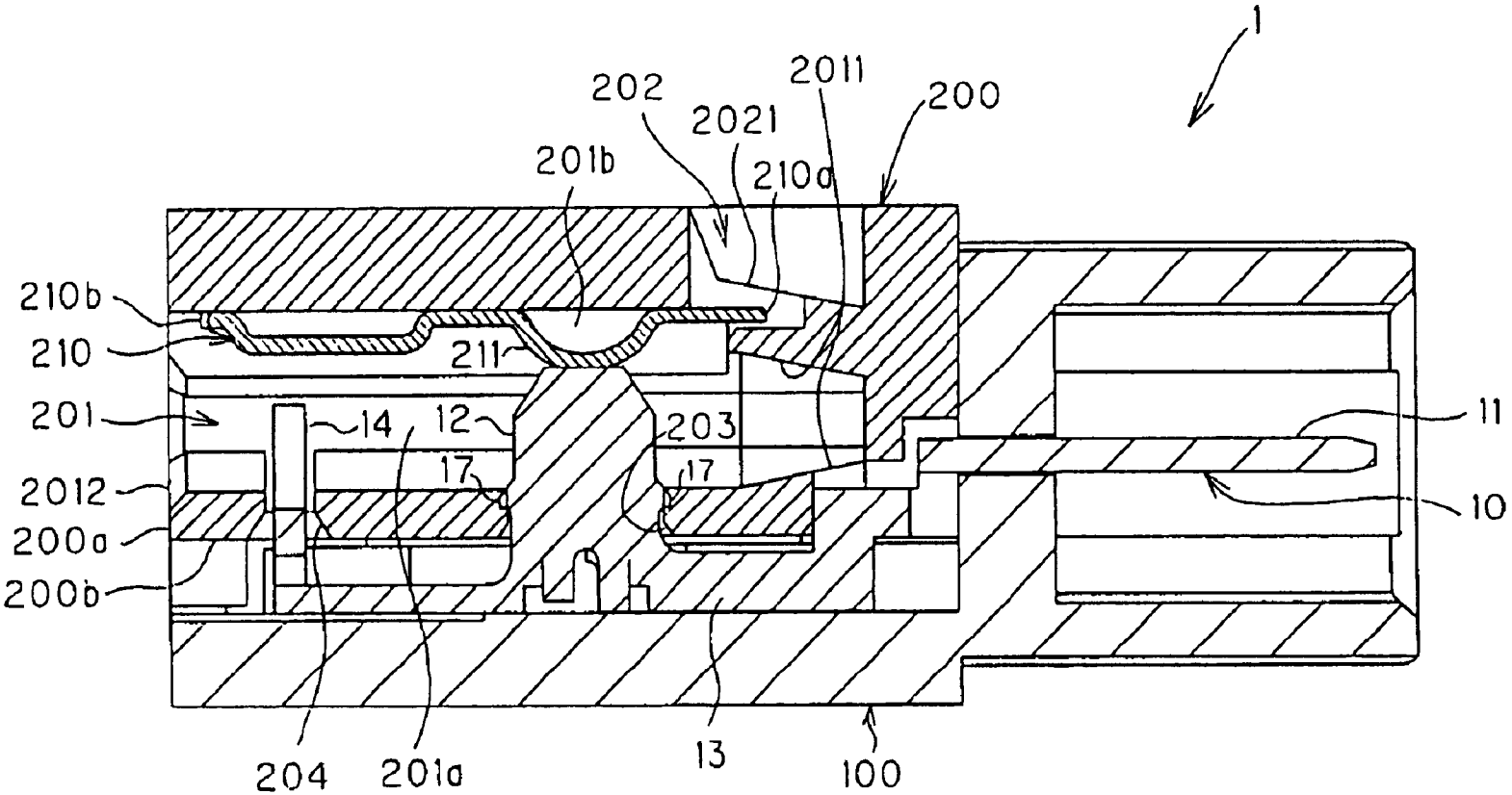
FIG. 4 is a sectional view taken along line A-A' of FIG. 3.
Figure 5:
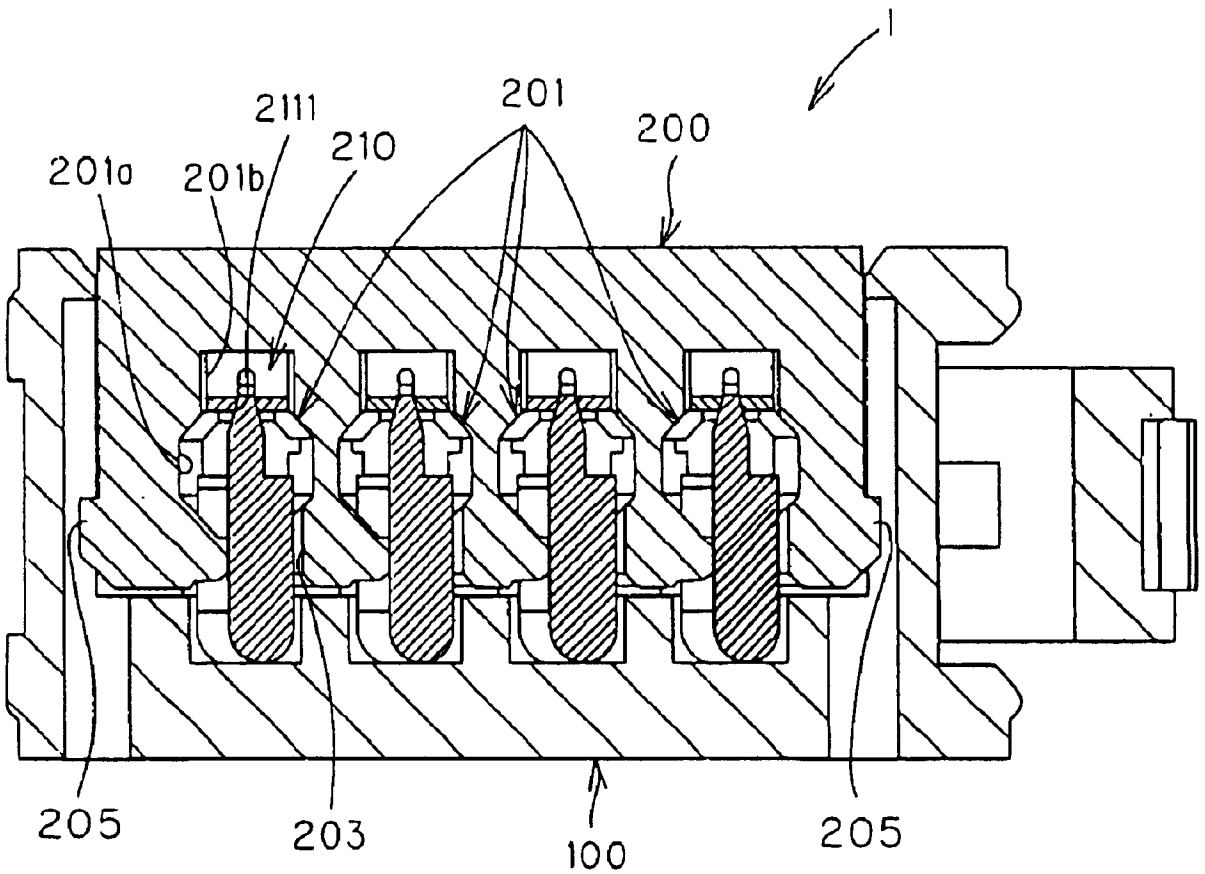
FIG. 5 is a sectional view taken along line B-B' of FIG. 3.

FIGS. 1 and 2 show an electrical connector 1. The electrical connector 1 includes a housing 100 and a terminal block 200 fitted to a rear side of the housing 100. A front side of the housing 100 has a mating connector receiving portion 1*a*. On a side opposite to the mating connector receiving portion 1*a*, the terminal block 200 has four electric wire-receiving passageways 201 arranged laterally in a line. As shown in FIG. 4, the electric wire-receiving passageways 201 are opened at 2012 to a back surface 200*a* of the terminal block 200 and extend from the back surface 200*a* to a front side of the terminal block 200. As shown in FIG. 5, only partitions of the terminal block 200 are provided between adjacent electric wire-receiving passageways 201 so that an array pitch of the electric wire-receiving passageways 201 is reduced and cracks during formation of the terminal block 200 are prevented. As shown in FIGS. 2 and 5, the electric wire-receiving passageways 201 have an octagonal portion 201*a* with one side notched like a rectangle at a center of a spring receiving passageway 201*b*. A die pin having a complementary shape may form the electric wire-receiving passageway 201. Additionally, cutting can form the die pin used for forming the passageway and the productivity of the die pin is thereby improved. As shown in FIG. 4, ends of the electric wire-receiving passageways 201 near the front side of the terminal block 200 have tapered surfaces 2011. The tapered surfaces 2011 are tilted toward an axis of the electric wire-receiving passageways 201 and taper downward. A groove 202 with a small thickness is formed above an end of the electric wire-receiving passageway 201. A bottom 2021 of the groove 202 is tilted in parallel with an upper portion of the tapered surface 2011.

As shown in FIGS. 4 and 5, the terminal block 200 has contact section receiving passageways 203 and contact holding section receiving passageways 204. The contact section receiving passageways 203 and the contact holding section receiving passageways 204 are formed in a bottom 200*b* of the terminal block 200 and extend into the electric wire-receiving passageways 201. As shown in FIG. 5, an outer peripheral wall of the terminal block 200 has a temporary locking protrusion 205 and a locking protrusion (not shown) that correspond to an actual locking protrusion of the housing 100 to lock the terminal block 200 to a locking section (not shown) of the housing 100. As shown in FIG. 2, a reverse u-shaped groove 206 is formed on the back surface 200*a* of the terminal block 200. The terminal block 200 may be made of a transparent resin material.

Figure 8:
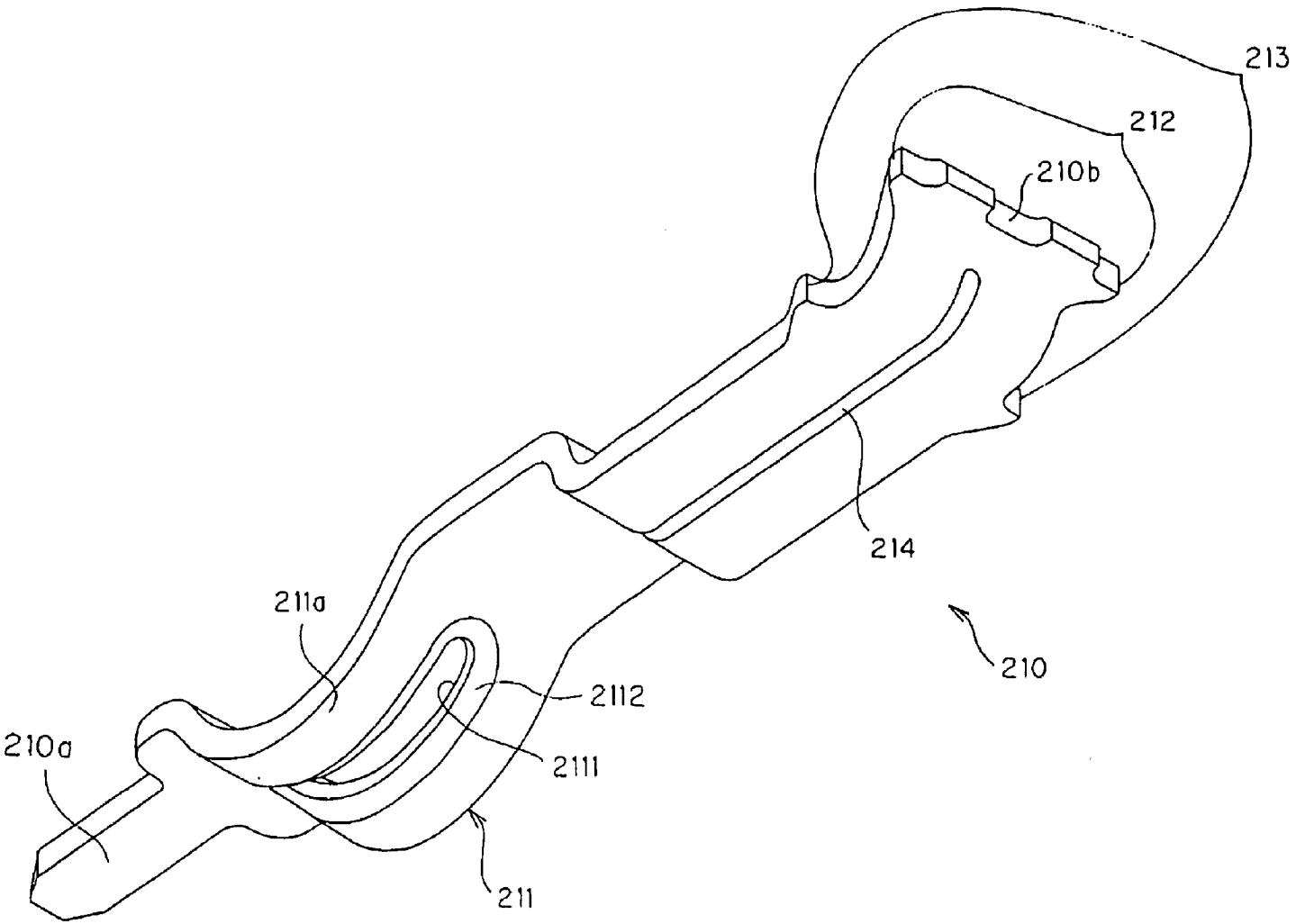
FIG. 8 is a perspective view of a spring member of the electrical connector of FIG. 1 from a first side.

As shown in FIGS. 4 and 5 a spring member 210 is provided in the spring receiving passageway 201*b* of the electric wire-receiving passageway 201. As best shown in FIG. 8, the spring member 210 is formed by die-cutting a metal plate and bending the plate. The spring member 210 has a free end 210*a* arranged in a space below the groove 202 of the terminal block 200, and a fixed end 210*b* press-fitted to the rear side of the terminal block 200 by first and second press-fitting portions 212, 213. The first and second press-fitting portions 212, 213 are press-fitted to an inner wall of the spring receiving passageway 201*b* near the opening 2012 of the electric wire-receiving passageway 201. The fixed end 210*b* serves as a supporting point for the spring member when an external force flexes the spring member 210 upward and downward. A contact retaining portion 211 and a bead 214 is provided between the free end 210*a* and the fixed end 210*b*. The bead 214 is formed from the fixed end 210*b* to the contact retaining portion 211. The contact retaining portion 211 contacts the male contact 10 and has a slit 2111 extending along a direction of length of the spring member 210. The slit 2111 increases the flexibility of the contact retaining portion 211. On a surface 211*a* of the contact retaining portion 211, a portion surrounding the slit 2111 is chamfered to form a C-shaped surface 2112.

Figure 6:
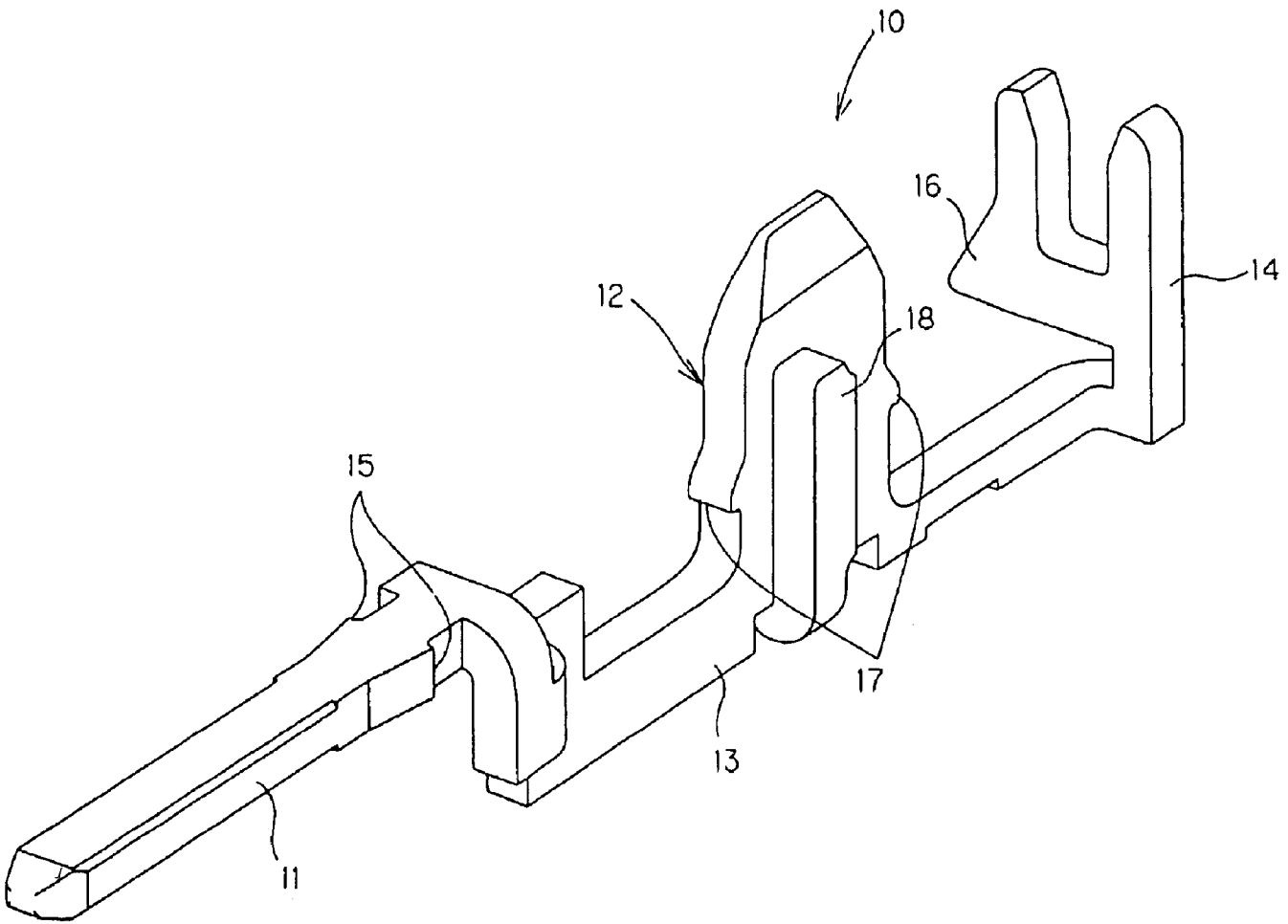
FIG. 6 is a perspective view of a male contact of the electrical connector of FIG. 1 from a first side.
Figure 7:
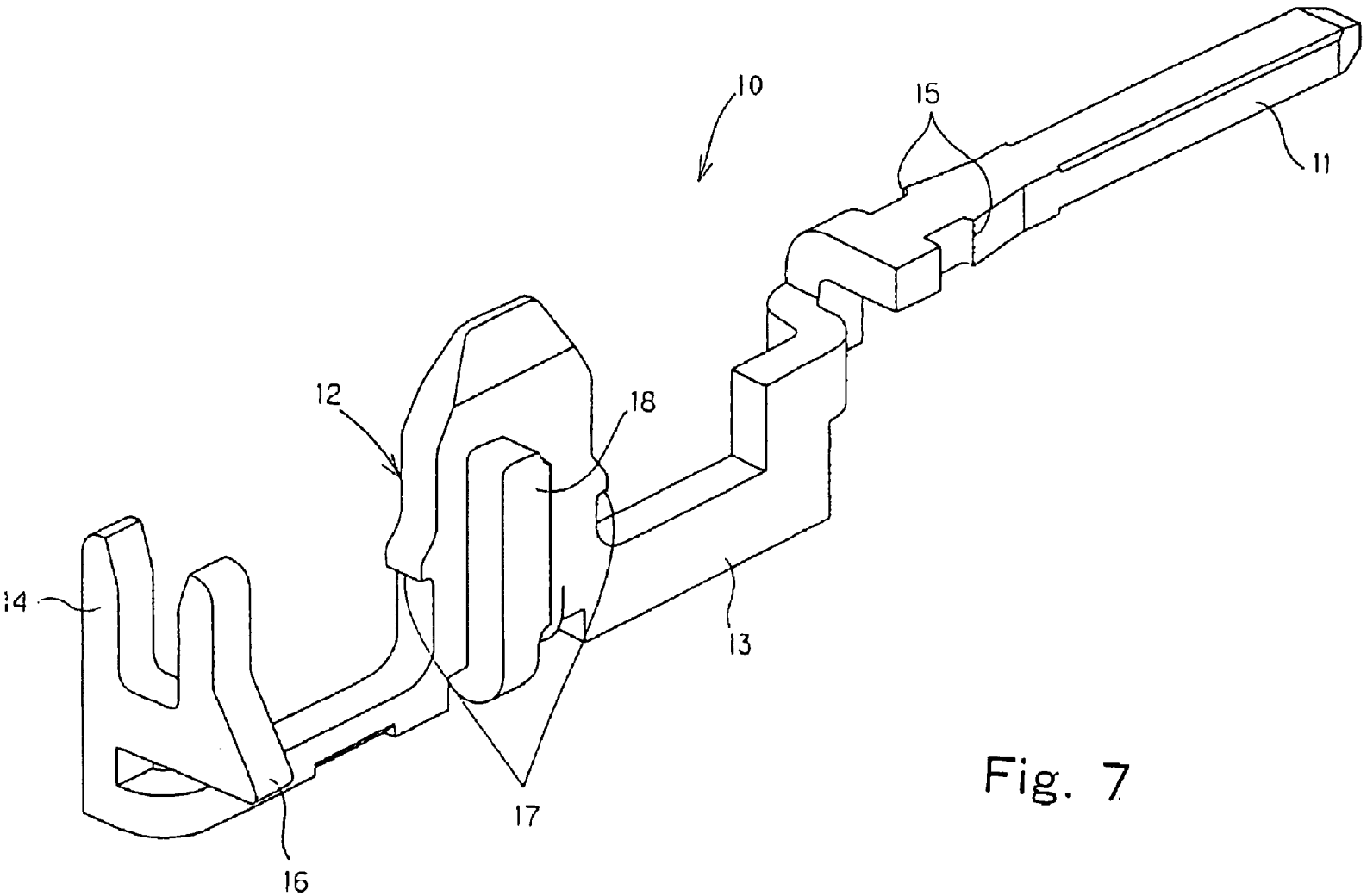
FIG. 7 is a perspective view of the male contact of FIG. 6 from a second side.

The electrical connector 1 holds a plurality of male contacts 10. As shown in FIG. 4, each of the male contacts 10 extends from the rear side to the front side of the electrical connector 1. The male contacts 10 are formed by die-cutting a metal plate and bending the plate. As shown in FIGS. 6 and 7, the male contact 10 has a base 13 provided with a piercing member 12, a bifurcated electric wire holding section 14, and a press-fit section 11. The press-fit section 11 has barbs 15 that rise from the base 13 and extend outward. The barbs 15 are press-fit into the housing 100 to hold the male contact 10 therein. The piercing member 12 extends upward from the base 13 and has a sharp tip. A terminal block press-fitting portion 17 is provided on a base portion of the piercing member 12 and has barbs that extend outward and downward toward the base 13. When the terminal block 200 is locked to the housing 100, the terminal block press-fitting portion 17 is press-fit to an inner wall of the contact section receiving passageway 203. A pair of support arms 18 flanks sides of the piercing member 12. The support arms 18 are formed by dividing a tongue piece of the base 13 that expands in an opposite direction from an expanding direction of the piercing member 12 into a press-fit section 11 and an electric wire holding section 14, respectively, and folding the divided tongue pieces by approximately 180°. The support arms 18 are thereby disposed on opposite sides of the piercing member 12. The bifurcated electric wire holding section 14 extends upward from the base 13 and toward the rear side of the electrical connector 1. A triangle stabilizer 16 protrudes laterally from one of the bifurcated sections of the electric wire holding section 14. The stabilizer 16 prevents the male contact 10 from moving downward within the housing 100. The base 13 of the male contact 10 in the housing 100 is positioned lower than the bottom 200*b* of the terminal block 200. Each of the male contacts 10 is arranged laterally at a predetermined pitch. Although the embodiment of the electrical connector 1 described herein is shown provided with the male contacts 10, the electrical connector 1 may also be used with female contacts. Additionally, although the embodiment of the electrical connector 1 described herein is shown having four of the male contacts 10, any desired number of male contacts 10 may be provided within the electrical connector 1.

Figure 9:
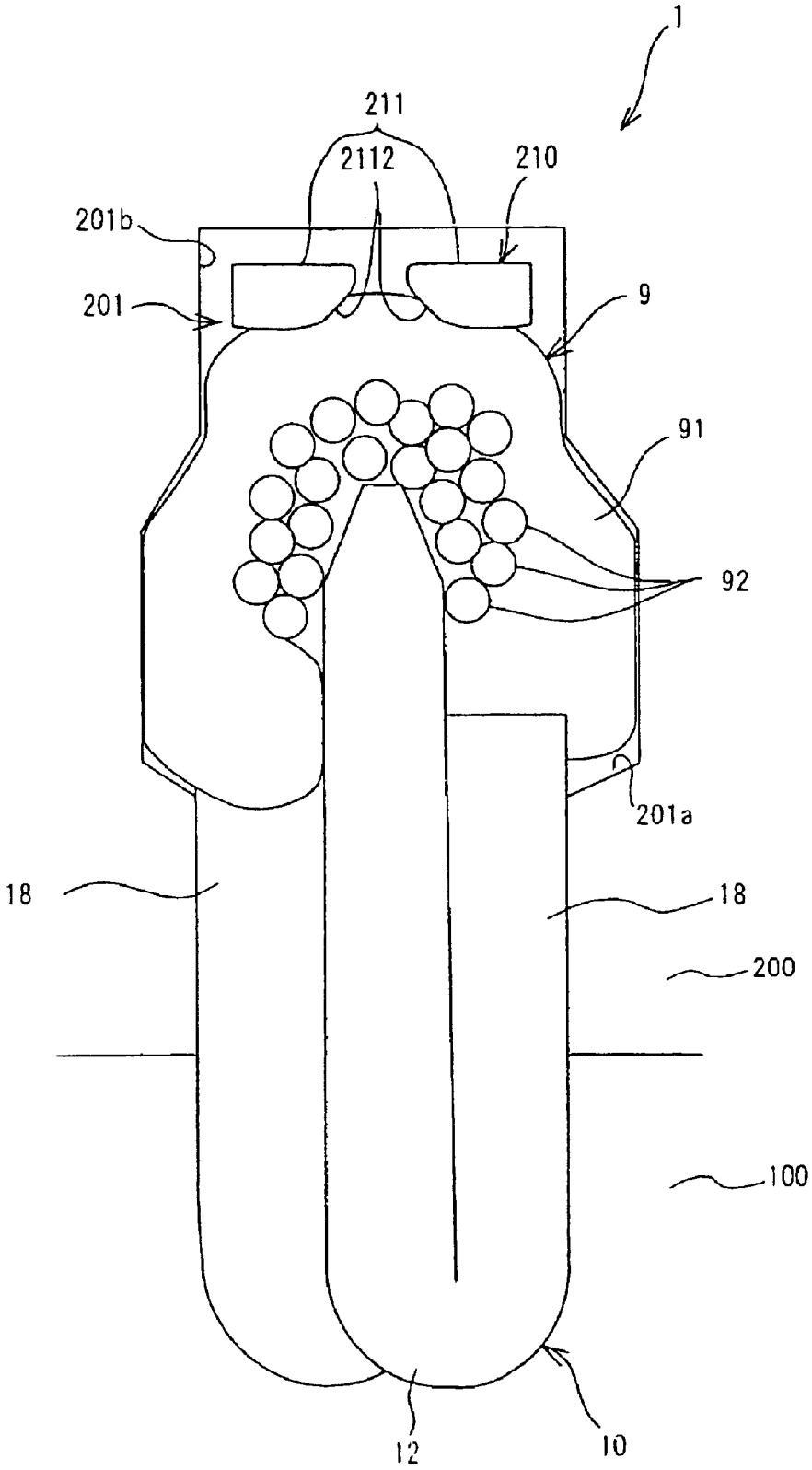
FIG. 9 is a diagram of the electrical connector of FIG. 1 connected with an electric wire.

The assembly of the electrical connector 1 will now be described in greater detail. The terminal block 200 is first disposed in a pre-latched position in relation to the housing 100 where the sharp tip of the piercing member 12 does not protrude into the electric wire receiving passageway 201. An electric wire 9 is inserted into the octagonal portion 201*a* of the electric wire-receiving passageway 201 from the opening 2012 on the back surface 200*a* of the terminal block 200. The electric wire 9 is of a large diameter and has plural core wires 92 sheathed within an elastic sheathing member 91, as shown in FIG. 9. The electric wire 9 is inserted into the electric wire-receiving passageway 201 with the plural core wires 92 sheathed. Although the electric wire 9 is circular in cross-section, because the length of a diagonal line of the octagon is larger than a diameter of the inscribed circle of the octagon and has a rectangular spring receiving passageway, the electric wire 9, although it has a large diameter, is easily be inserted. The electric wire 9 is guided by the C-shaped surface 2112 and the tapered surface 2011 so as to cause the core of the electric wire 9 to coincide with an axis of the electric wire-receiving passageway 201.

The electric wire 9 is inserted until an end of the electric wire 9 makes contact with the tapered surfaces 2011. The end of the electric wire 9 is pushed still further until the electric wire 9 is temporarily held in position by the tapered surfaces 2011. This position prevents electric wires with small diameters from falling-out of the electric wire-receiving passageway 201. Because the terminal block 200 is made of a transparent resin material, a user may visually confirm whether or not the end of the electric wire 9 has reached the end of the electric wire-receiving passageway 201. Additionally, the groove 202 above the end of the electric wire-receiving passageway 201 permits visual confirmation that the end of the electric wire 9 is correctly positioned.

The terminal block 200 is pushed downward into permanent locking engagement with the housing 100. The electric wire 9 is firmly held by the electric wire holding section 14 by the elasticity of the sheathing member 91. The piercing member 12 of the male contact 10 positioned at the axis of the electric wire-receiving passageway 201 is thereby forced to protrude from the contact section receiving passageway 203 orthogonally into the electric wire-receiving passageway 201. The piercing member 12 pushes the spring member 210 upward via the electric wire 9. Simultaneously, the spring member 210 urges the electric wire 9 received in the electric wire-receiving passageway 201 toward the piercing member 12 so that the sharp tip pierces a sheathing member 91 of the electric wire 9 and makes contact with the plural core wires 92 from below. When the electric wire-receiving passageways 201 do not house any of the electric wires 9, the sharp tip of the piercing member 12 enters the slit 2111 on the contact retaining portion 211 of the spring member 12. The support arms 18 press the electric wire 9 toward the contact retaining portion 211 of the spring member 210. Since the terminal block 200 has the spring member 210, deformation of the electric wire 9 can be prevented when the connection is made.

After connection is made, a probe is inserted into the groove 206 shaped like a reversed letter U and is brought into contact with the rear end of the male contact 10 to check conduction between the electric wire 9 and the male contact 10.

In the electrical connector 1, the spring receiving passageway 102*b* is a space expanding from the electric wire-receiving passageway 201 in a protruding direction of the piercing member 12. The center of the electric wire-receiving passageway 201 and the center of the spring receiving passageway 102*b* coincide with each other. Hence, when the piercing member 12 is pierced into the electric wire 9, the sheathing member 91 moves toward the spring receiving passageway 102*b* in a line extended in a direction of the received external force. Thus, the sheathing member 91 is not slanted to one side in the electric wire-receiving passageway 201. When connection is made, therefore, the piercing member 12 pierces into a center of the core wires 92, electrically connecting the piercing member 12 and the core wires 92 in a preferred manner.

At the same time, the electric wire 9 is urged from above in a downward direction by the contact retaining portion 211 of the spring member 210, and the surrounding section of the electric wire 9 is restrained by the wall of the octagonal portion 201*a* such that the plural core wires 92 are prevented from spreading-out in the sheathing member 91. The piercing member 12 of the male contact 10 and the core wires 92 of the electric wire 9, therefore, make a sound electrical connection. Even when the elasticity of the sheathing member 91 is lost by secular changes, the electric wire 9 is urged toward the piercing member 12 by the spring member 210 and is pressed to the contact retaining portion 211 by the support arms 18. It is, thereby possible to prevent electrical disconnection caused by movement of the electric wire 9 relative to the piercing member 12.

Further, since the spring member 210 is disposed in a position opposed to the end of the piercing member 12 which protrudes into the electric wire-receiving passageway 201, even when multiple electric wires 9 are arranged laterally at smaller intervals between adjacent electric wires 9, the spring receiving passageway 201*b* that receives the spring members 210 does not need to be altered and as such does not effect the array pitch of the contacts 10 or the spacing between the electrical wires 9. Consequently, the electrical connector 1 may be used for a large-diameter electric wire.

When a portion other than the core wires 92 of the electric wire 9 is pressed, the sheathing member 91 of the electric wire 9 is slanted to one side in the electric wire-receiving passageway 201 and the core wires 92 are also slanted resulting in no contact with the piercing member 12.

I claim:

1. An electrical connector, comprising:

a terminal block having an electric wire receiving passageway that communicates with a spring receiving passageway;

a housing provided with a contact, the contact having a piercing member that extends into the electric wire receiving passageway for piercing a sheathing member of an electric wire received in the electric wire receiving passageway; and a spring member arranged in the spring receiving passageway, the spring member having a contact retaining portion that urges the electric wire toward the piercing member.

2. The electrical connector of claim 1, wherein the terminal block moves between a pre-latched position and a locked position, the piercing member protrudes into the electric wire receiving passageway to pierce the electric wire in the locked position.

3. The electrical connector of claim 1, wherein the spring member is formed from a metal plate.

4. The electrical connector of claim 1, wherein the spring member has a fixed end press-fitted into the terminal block.

5. The electrical connector of claim 1, wherein the contact retaining portion has a slit for receiving the piercing member, the piercing member being arranged in the slit prior to receipt of the electric wire in the electric wire receiving passageway.

6. The electrical connector of claim 1, wherein the spring member has a fixed end and a free end and a bead is provided between the fixed end and the free end.

7. The electrical connector of claim 1, wherein the electric wire receiving passageway and the spring receiving passageway extend in a direction parallel to each other.

8. The electrical connector of claim 1, wherein the electric wire receiving passageway has an octagonal shape to limit deformation of the electric wire.

9. The electrical connector of claim 1, wherein the terminal block is formed from a transparent resin to check positioning of the electric wire.

10. The electrical connector of claim 1, wherein the contact retaining portion has a slit for increasing flexibility of the contact retaining portion.

11. The electrical connector of claim 2, wherein the contact includes a support arm that presses the electric wire toward the spring member.

12. The electrical connector of claim 5, wherein the slit is chamfered for guiding the electric wire.

13. An electrical connector, comprising:

a terminal block having an electric wire receiving passageway that communicates with a spring receiving passageway, the terminal block moves between a pre-latched position and a locked position;

a housing provided with a contact, the contact having a piercing member for piercing a sheathing member of an electric wire and urging the electric wire toward the spring receiving passageway when the terminal block is moved to the locked position; and a spring member arranged in the spring receiving passageway, the spring member having a contact retaining portion for urging the electric wire toward the piercing member as the piercing member urges the electric wire toward the contact retaining portion.

14. The electrical connector of claim 13, wherein the piercing member orthogonally extends into the electric wire receiving passageway when the terminal block is in the locked position.

15. The electrical connector of claim 13, wherein the contact includes a support arm that presses the electric wire toward the spring member.

16. The electrical connector of claim 13, wherein the spring member is formed from a metal plate.

17. The electrical connector of claim 13, wherein the spring member has a fixed end press-fitted into the terminal block.

18. The electrical connector of claim 13, wherein the contact retaining portion has a slit for receiving the piercing member, the piercing member being arranged in the slit prior to receipt of the electric wire in the electric wire receiving passageway.

19. The electrical connector of claim 18, wherein the slit is chamfered for guiding the electric wire.

20. The electrical connector of claim 13, wherein the spring member has a fixed end and a free end and a bead is provided between the fixed end and the free end.

21. The electrical connector of claim 13, wherein the electric wire receiving passageway and the spring receiving passageway extend in a direction parallel to each other.

22. The electrical connector of claim 13, wherein the electric wire receiving passageway has an octagonal shape to limit deformation of the electric wire.

23. The electrical connector of claim 10, wherein the slit is chamfered for guiding the electric wire.

24. The electrical connector of claim 13, wherein the contact retaining portion has a slit for increasing flexibility of the contact retaining portion.

25. The electrical connector of claim 24, wherein the slit is chamfered for guiding the electric wire.

* * * * *